United States Patent [19]

Nishii et al.

[11] Patent Number: 4,732,701

[45] Date of Patent: Mar. 22, 1988

[54] POLYMER COMPOSITION HAVING POSITIVE TEMPERATURE COEFFICIENT CHARACTERISTICS

[75] Inventors: Motoi Nishii, Ohmihachiman; Hitoshi Miyake; Hideto Fujii, both of Sodegaura, all of Japan

[73] Assignee: Idemitsu Kosan Company Limited, Tokyo, Japan

[21] Appl. No.: 934,495

[22] Filed: Nov. 24, 1986

[30] Foreign Application Priority Data

Dec. 3, 1985 [JP] Japan ..... 60-270700

[51] Int. Cl.[4] ..... H01B 1/06

[52] U.S. Cl. ..... 252/511; 252/503; 252/504; 252/506; 252/516; 252/512; 252/518; 252/507; 252/520; 524/404; 524/443

[58] Field of Search ..... 252/502, 507, 504, 503, 252/506, 511, 520, 516, 512, 518; 524/404, 439, 495, 496, 442, 443

[56] References Cited

U.S. PATENT DOCUMENTS

| | | | |
|---|---|---|---|
| 3,993,602 | 11/1976 | Prochazka | 252/504 |
| 4,209,474 | 6/1980 | Prochazka | 252/504 |
| 4,534,889 | 8/1985 | van Konynenburg et al. | 252/511 |
| 4,545,926 | 10/1985 | Fouts et al. | 252/511 |
| 4,552,689 | 11/1985 | Yui et al. | 252/511 |
| 4,555,358 | 11/1985 | Matsushita et al. | 252/516 |
| 4,629,869 | 12/1986 | Bronnvall | 252/511 |
| 4,633,064 | 12/1986 | Atsumi et al. | 252/516 |

FOREIGN PATENT DOCUMENTS

| | | |
|---|---|---|
| 50-33707 | 11/1975 | Japan . |
| 56-10352 | 3/1981 | Japan . |

*Primary Examiner*—Josephine Barr

*Attorney, Agent, or Firm*—Frishauf, Holtz, Goodman & Woodward

[57] ABSTRACT

A polymer composition having positive temperature coefficient characteristics is described, comprising 100 parts by weight of a mixture consisting of from 40 to 90% by weight of a crystalline polymer and from 60 to 10% by weight of an electrically conductive powder and from 10 to 300 parts by weight of a semiconductive inorganic substance. This polymer composition can withstand high voltage and when used as a heat generator, produces a uniform distribution of heat and has a long service life. Thus the polymer composition is useful for production of an overcurrent protecting element and a heat generator.

13 Claims, No Drawings

POLYMER COMPOSITION HAVING POSITIVE TEMPERATURE COEFFICIENT CHARACTERISTICS

BACKGROUND OF THE INVENTION

The present invention relates to a polymer composition having positive temperature coefficient characteristics of the electric resistance and more particularly to a polymer composition having positive temperature coefficient characteristics which can withstand high voltage and further which when used as a heat generator, produces a uniform distribution of heat, has a long service life and thus can be utilized as an overcurrent-protecting element or a heat generator.

Compositions prepared by compounding electrically conductive particles such as carbon black to crystalline polymers or inorganic substances such as barium titanate are known to have the positive temperature coefficient characteristics that an electric resistance value abruptly increases when the temperature reaches a specified temperature range (see, for example, Japanese Patent Publication Nos. 33707/1975 and 10352/1981).

These conventional compositions are useful as overcurrentprotecting elements or heat generators. When, however, they are used under relatively high voltage conditions or unexpected overvoltage is applied thereto, they cannot withstand such relatively high voltage or unexpected overvoltage and thus break down.

SUMMARY OF THE INVENTION

The present invention is intended to overcome the above problems and an object of the present invention is to provide a polymer composition which has satisfactory positive temperature coefficient characteristics and can withstand sufficiently high voltage.

It has been found that the object can be attained by using a composition which is prepared by compounding a semiconductive inorganic substance to a mixture of a crystalline polymer and an electrically conductive powder.

The present invention relates to a polymer composition having positive temperature coefficient characteristics as prepared by compounding from 10 to 300 parts by weight of a semiconductive inorganic substance having a specific resistance of from $10^{-2}$ to $10^{8}$ Ω-cm to 100 parts by weight of a mixture of from 40 to 90% by weight of a crystalline polymer and from 60 to 10% by weight of an electrically conductive powder.

DETAILED DESCRIPTION OF THE INVENTION

There are no special limitations to the crystalline polymer as used herein; various crystalline polymers can be used in the present invention. Typical examples of such crystalline polymers are polyolefins such as high density polyethylene, low density polyethylene, polypropylene, olefin copolymers such as ethylene-propylene copolymer, and ethylene-vinylacetate copolymer, polyamide, polyester, fluorine-containing ethylene-based polymer and their modified products. These compounds can be used alone or in combination with each other.

As the electrically conductive powder as used herein, various electrically conductive powders can be used. Typical examples of such powders are carbon black such as oil furnace black, thermal black and acetylene black; graphite; metal powders; powdered carbon fibers, and mixtures thereof. Particularly preferred are carbon black and graphite. Carbon black as used herein has an average particle diameter of from 10 to 200 mμ, preferably from 15 to 100 mμ. If the average particle diameter is less than 10 mμ, the electric resistance does not sufficiently increase when the specified temperature range is reached. On the other hand, if the average particle diameter is in excess of 200 μm the electric resistance at room temperature undesirably increases.

A mixture of two or more electrically conductive powders having varied particle diameters may be used as the above electrically conductive powder.

In the above crystalline polymer-electrically conductive powder mixture, the proportion of the crystalline polymer is from 40 to 90% by weight and preferably from 50 to 80% by weight, and the proportion of the electrically conductive powder is from 60 to 10% by weight and preferably from 50 to 20% by weight. If the proportion of the electrically conductive powder is in excess of the above upper limit, sufficiently satisfactory positive temperature coefficient characteristics cannot be obtained. If the proportion of the electrically conductive powder is less than the above lower limit, sufficiently satisfactory electrical conductivity cannot be obtained.

The polymer composition of the present invention is prepared by compounding a semiconductive inorganic substance having a specific resistance of from $10^{-2}$ to $10^{8}$ Ω-cm to the above crystalline polymer-electrically conductive powder mixture. Typical examples of semiconductive inorganic substances which can be used are carbides such as silicon carbide and boron carbide, and titanium black. Of these compounds, carbides such as silicon carbide and boron carbide are preferred.

The semiconductive inorganic substance is in either a powdery form or a fibrous form. The semiconductive inorganic powder has an average particle diameter of not more than 300 μm and preferably not more than 100 μm. If the average particle diameter is in excess of 300 μm, the effect of increasing voltage resistance is undesirably decreased. In connection with the semiconductive inorganic fiber, it is preferred that the diameter is from 0.1 to 100 μm and the length is from 1 to 5,000 μm.

In compounding the semiconductive inorganic substance to the crystalline polymer-electrically conductive powder mixture, the amount of the semiconductive inorganic substance compounded is from 10 to 300 parts by weight, preferably from 15 to 200 parts by weight per 100 parts by weight of the mixture. If the amount of the semiconductive inorganic substance compounded is less than 10 parts by weight, sufficiently satisfactory voltage resistance cannot be obtained. On the other hand, if the amount of the semiconductive inorganic substance compounded is in excess of 300 parts by weight, the resulting mixture undesirably becomes difficult to knead.

The above two components are kneaded by the usual techniques such as by the use of usual kneading machines, e.g., a Banbury's mixer and a kneading roll. The kneading temperature is not critical. It is usually not lower than the melting point of the crystalline polymer to be used and preferably at least 30° C. higher than the melting point of the crystalline polymer to be used. By kneading the two components at the above defined temperature, the specific resistance at ordinary temperature can be decreased. In connection with the kneading time, it suffices that the kneading time after a temperature higher than the melting point of the crystalline polymer to be used is reached is not less than 5 minutes. During the process of kneading or after kneading, a crosslinking agent, e.g. organic peroxides may be added. Typical examples of organic peroxides which can be used are 2,5-dimethyl-2,5-di(tert-butylperoxy)-hexyne-3, benzoyl peroxide, tert-butylperoxy benzoate, dicumyl peroxide, tert-butylcumyl peroxide, and di-tert-butyl peroxide. If desired, the kneaded material may be cross-linked with radiations after its molding.

The above-prepared polymer composition having positive temperature coefficient characteristics is molded into desired forms by various known techniques to produce the final products such as an electric element.

The polymer composition of the present invention permits production of electric elements having such positive temperature coefficient characteristics that the voltage resistance, particularly the resistance against instantaneous overvoltage is high. A heat generator produced by molding the polymer composition of the present invention produces uniform distribution of heat and has a long service life because the semi-conductive inorganic component generates heat at the same time and is excellent in heat conductivity. In addition, the polymer composition of the present invention is high in the resistance increasing rate when a specified temperature range is reached.

Accordingly the polymer composition of the present invention can be used in production of overcurrent protecting elements, heat generators, in particular, high voltage overcurrent protecting elements.

The present invention is described in greater detail with reference to the following examples.

EXAMPLE 1

Twenty-four grams (g) of high density polyethylene (Idemitsu Polyethylene 520B produced by Idemitsu Petrochemical Co., Ltd.) as a crystalline polymer and 16 g of carbon black (Diablack E produced by Mitsubishi Chemical Industries Ltd.; average particle diameter: 43 mμ) as an electrically conductive powder were mixed. To 100 parts by weight of the resulting mixture was compounded with 100 parts by weight of silicon carbide powder (SiC #4000 produced by Fujimi Kenmazai Kogyo Co., Ltd.; average particle diameter: 3 μm; specific resistance: 110 Ω-cm), and the resulting mixture was introduced in a kneader (Laboplastomill produced by Toyo Seiki Seisakusho Co., Ltd.) where it was melted and kneaded. Then 0.6 part by weight of 2,5-dimethyl-2,5-di(tert-butylperoxy)hexyne-3 was added as a cross-linking agent, and the resulting mixture was further kneaded to prepare a polymer composition having positive temperature coefficient characteristics.

The above-prepared polymer composition was press molded to produce a sheet. This sheet was sandwiched between two electrolytic nickel foils (Fukuda Metal Foil & Powder Co., Ltd.) having a thickness of 35 μm and then pressed by the use of a press molding machine to produce a 1.8 mm thick laminated sheet. A 8 mm×9 mm piece was cut away from the laminated sheet. The electric resistance at room temperature between the nickel foils was measured and found to be 20 Ω (specific resistance: 80 Ω-cm). Then the piece was heated to 130° C. and at this temperature, measured for the electric resistance. The ratio of the electric resistance at 130° C. to that at room temperature (resistance increasing rate) was $10^{6.1}$. In addition, the piece was measured for a dynamic voltage resistance, i.e., a voltage at which the piece was broken when it was applied instantaneously to the piece at room temperature. The dynamic voltage resistance was 630 V. In connection with a static voltage resistance, i.e., a voltage at which the piece was broken when it was gradually applied to the piece, even if the voltage was increased to 1,000 V, the piece did not break down.

Lead-wires were soldered to the nickel foils, and the piece was entirely covered with an epoxy resin. This piece was measured for the dynamic and static voltage resistances in the same manner as above with the same results as above.

EXAMPLE 2

A laminated sheet was produced in the same manner as in Example 1 except that 100 parts by weight of boron carbide powder (Denkaboron F1 produced by Denki Kagaku Kogyo K.K.; average particle diameter: 5 μm; specific resistance: 0.55 Ω-cm) was used as the semiconductive inorganic substance.

A 7 mm×8 mm piece was cut away from the laminated sheet and measured for the electric resistance at room temperature. The electric resistance at room temperature was 20 Ω (specific resistance: 62 Ω-cm). The resistance increasing rate at 130° C. was $10^{6.2}$. The dynamic voltage resistance of the piece was 450 V. In connection with the static voltage resistance, the piece did not break down even at 1,000 V.

Lead-wires were connected to the piece in the same manner as in Example 1. This piece was entirely covered with an epoxy resin and measured for the dynamic and static voltage resistances with the same results as above.

COMPARATIVE EXAMPLE 1

The same high density polyethylene-carbon black mixture as in Example 1 was kneaded in a kneader (Laboplastomill), and then the same cross-linking agent as in Example 1 was added to prepare a kneaded composition. Using this composition, a 2.0 mm thick laminated sheet was produced in the same manner as in Example 1.

A 8 mm×8 mm piece was cut away from the above laminated sheet, and then measured for the electric resistance at room temperature. The electric resistance at room temperature was 20 Ω (specific resistance: 64 Ω-cm). The resistance increasing rate when the temperature was raised to 130° C. was $10^{7.5}$. The dynamic voltage resistance of the piece was 300 V. In connection with the static voltage resistance, the piece was not broken even at 1,000 V.

COMPARATIVE EXAMPLE 2

A 1.8 mm thick laminated sheet was produced in the same manner as in Example 1 except that 100 parts by weight of aluminum hydroxide (B703 produced by Nippon Light Metal Co., Ltd.; average particle diameter: 0.4 μm), which was electrically insulative, was used in place of the silicon carbide powder.

A 6 mm×6 mm piece was cut away from the above laminated sheet and measured for the electric resistance at room temperature. The electric resistance at room temperature was 20 Ω (specific resistance: 40 Ω-cm). The resistance increasing rate when the temperature was raised to 130° C. was $10^{6.1}$. The dynamic voltage resistance of the piece was 355 V and the static voltage resistance was 700 V.

EXAMPLE 3

24.6 g of high density polyethylene (Idemitsu Polyethylene 540B produced by Idemitsu Petrochemical Co., Ltd.) as a crystalline polymer and 15.4 g of carbon black (Diablack E produced by Mitsubishi Chemical Industries, Ltd.; average particle diameter: 43 mμ) as an electrically conductive powder were mixed. To 100 parts by weight of the resulting mixture was compounded with 100 parts by weight of silicon carbide powder (SiC #2000 produced by Fujimi Kenmazai Kogyo Co., Ltd.; average particle diameter: about 8 μm; specific resistance: 90 Ω-cm), and the resulting mixture was introduced in a kneader (Laboplastomill) where it was melted and kneaded. Then 0.18 part by weight of 2,5-dimethyl-2,5-di(tert-butyl-peroxy)hexyne-3 was added as a cross-linking agent, and the resulting mixture was further kneaded to prepare a polymer composition having positive temperature coefficient characteristics.

The above-prepared polymer composition was press molded to produce a sheet. This sheet was sandwiched between two electrolytic nickel foils with one-sided rough phase having a thickness of 20 μm and then pressed by the use of a hot press molding machine to produce a 1.8 mm thick laminated sheet. A 5 mm×9 mm piece was cut away from the laminated sheet. The electric resistance at room temperature between the nickel foils was measured and found to be 20 Ω (specific resistance: 50 Ω-cm). The resistance increasing rate at 130° C. was $10^{5.8}$. The dynamic voltage resistance of the piece was 600 V. In connection with the static voltage resistance, the piece was not broken even at 1,000 V. Lead-wires were connected to the piece, and said piece was entirely covered with an epoxy resin in the same manner as in Example 1, and measured for the dynamic voltage resistance, and it was 630 V.

In connection with the static voltage resistance, the piece did not break down even at 1,000 V.

EXAMPLE 4

A laminated sheet was produced in the same manner as in Example 3 except that 125 parts by weight of silicon carbide powder (SiC #4000 produced by Fujimi Kenmazai Kogyo Co., Ltd.) was added to 100 parts by weight of the mixture comprising 21.2 g of high density polyethylene and 14.9 g of carbon black.

A 6 mm×7 mm piece was cut away from the laminated sheet, and measured for the electric resistance at room temperature. The electric resistance at room temperature was 20 Ω (specific resistance: 47 Ω-cm). The resistance increasing rate at 130° C. was $10^{5.0}$. The dynamic voltage resistance of the piece was 560 V. In connection with the static voltage resistance, the piece was not broken even at 1,000 V.

Lead-wires were connected to the piece, and said piece was entirely covered with an epoxy resin in the same manner as in Example 1, and measured for the dynamic voltage resistance, at it was 600 V. In connection with the static voltage resistance, the piece did not break down even at 1,000 V.

COMPARATIVE EXAMPLE 3

A laminated sheet was produced in the same manner as in Example 3 except that 100 parts by weight of silicon nitride powder (SN-B produced by Denki Kagaku Kogyo K.K.; average particle diameter; <44 μm; specific resistance: $>10^{10}$ Ω-cm) was added to 100 parts by weight of the mixture comprising 25.4 g of high density polyethylene and 14.6 g of carbon black and 0.19 parts by weight of the cross-linking agent was used.

A 5 mm×9 mm piece was cut away from the laminated sheet, and measured for the electric resistance at room temperature. The electric resistance at room temperature was 20 Ω (specific resistance: 50 Ω-cm). The resistance increasing rate was $10^{6.3}$. The dynamic voltage resistance of the piece was 315 V. In connection with the static voltage resistance, the piece was not broken even at 1,000 V.

Lead-wires were connected to the piece, and the piece was entirely covered with an epoxy resin. The dynamic voltage resistance of the piece was 355 V. In connection with the static voltage resistance, the piece was not broken even at 1,000 V.

COMPARATIVE EXAMPLE 4

A laminated sheet was produced in the same manner as in Example 3 except that 100 parts by weight of titanium nitride powder (TiN produced by Nippon Shinkinzoku Co., Ltd.; average particle diameter: about 1.5 μm; specific resistance: $4\times10^{-5}$ Ω-cm) was added to 100 parts by weight of the mixture comprising 29.7 g of high density polyethylene and 15.3 g of carbon black, and 0.20 parts by weight of the cross-linking agent was used.

A 5 mm×9 mm piece was cut away from the laminated sheet, and measured for the electric resistance at room temperature. The electric resistance at room temperature was 20 Ω (specific resistance: 50 Ω-cm). The resistance increasing rate was $10^{6.2}$. The dynamic voltage resistance of the piece was 280 V, and the static voltage resistance of the piece was 700 V.

Lead-wires were connected to the piece in the same manner as in Example 1. This piece was entirely covered with an epoxy resin and measured for the dynamic and static voltage resistances with the same results as above.

EXAMPLE 5

Thirty-two grams of low density polyethylene (Petrothene170 produced by Toyo Soda Kogyo Co., Ltd.) and 19 g of carbon black (same as in Example 1) were mixed. To 100 parts by weight of the resulting mixture was compounded with 96 parts by weight of silicon carbide powder (SiC #4000), and the resulting mixture was introduced in a kneader (Laboplastomill) where it was melted and kneaded to obtain a polymer composition.

A 10 mm×10 mm piece was cut away from the laminated sheet having a thickness of 1 mm which was prepared in the same manner as in Example 3. The electric resistance at room temperature was measured and the specific resistance was 56 Ω-cm, and the resistance increasing rate was $10^{4.6}$.

A 40 mm×40 mm piece was cut away from the laminated sheet, and lead-wires were connected to the piece, and it was coated by black paint. After 30 V of DC was charged for 5 minutes, the temperature distribution of the surface was measured by infrared imager (infrared indication thermometer). The heighest temperature of the surface was 99° C. and the difference between said heighest temperature and the lowest temperature was 4° C. Accordingly, it was found that the surface temperature is almost uniform, and the temperature at the center of the surface is higher, while the temperature at the surroundings is lower due to the radiation. The result shows that the temperature distribution of the surface is proper. The change of the surface temperature was +1% after charge for 200 hours and also the change in the resistance value after cooling was ±0%.

EXAMPLE 6

Thirty-five grams of ethylene-vinyl acetate copolymers (Ultrathene-UE-634 produced by Toyo Soda Kogyo Co., Ltd.) and 26 g of carbon black (same as in Example 1) were mixed. To 100 parts by weight of the resulting mixture was compounded with 64 parts by weight of silicon carbide (SiC #4000), and the resulting mixture was introduced in a kneader (Laboplastomill) where it was melted and kneaded to obtain a polymer composition.

A 10 mm×10 mm piece was cut away from the laminated sheet having a thickness of 1 mm which was prepared in the same manner as in Example 3. The electric resistance at room temperature was measured and the specific resistance was 62 Ω-cm, and the resistance increasing rate was $10^{3.2}$.

A 40 mm×40 mm piece was cut away from the laminated sheet, and lead-wires were connected to the piece. After 30 V of DC was charged for 5 minutes, the temperature distribution of the surface was measured as in Example 5, and found that the heighest temperature of the surface was 72° C. and the difference between said heighest temperature and the lowest temperature was 6° C. Accordingly, it was found that the surface temperature is almost uniform and the temperature distribution of the surface is proper. The change of the surface temperature was -2% after charge for 200 hours and also the change in the resistance value after cooling was +20%.

COMPARATIVE EXAMPLE 5

Test piece was obtained in the same manner as in Example 5 except that 49 g of low density polyethylene and 21 g of carbon black were used. The specific resistance of the piece was 60 Ω-cm, and the resistance increasing rate was $10^{4.9}$.

A 40 mm×40 mm piece was cut away from the laminated sheet, and lead-wires were connected to the piece. After 30 V of DC was charged for 5 minutes, the temperature distribution of the surface was measured as in Example 5, and found that the heighest temperature of the surface was 75° C. and the difference between said heighest temperature and the lowest temperature was more than 10° C. Furthermore, the temperature distribution of the surface was random. The change of the surface temperature was +6% after charge for 200 hours and also the change in the resistance value after cooling was +80%.

COMPARATIVE EXAMPLE 6

Test piece was obtained in the same manner as in Example 6 except that 40 g of ethylene-vinyl acetate copolymer and 30 g of carbon black were used. The specific resistance of the piece was 60 Ω-cm, and the resistance increasing rate was $10^{3.3}$.

A 40 mm×40 mm piece was cut away from the laminated sheet, and lead-wires were connected to the piece. After 30 V of DC was charged for 5 minutes, the temperature distribution of the surface was measured as in Example 5, and found that the heighest temperature was 67° C. and the difference between said heighest temperature and the lowest temperature was 10° C. Furthermore, the temperature distribution of the surface was random. The change of the surface temperature was +20% after charge for 200 hours and also the change in the resistance value after cooling was +50%.

What is claimed is:

1. A polymer composition having positive temperature coefficient characteristics, comprising 100 parts by weight of a mixture consisting of from 40 by 90% by weight of a crystalline polymer and from 60 to 10% by weight of an electrically conductive powder having a particle diameter of from 10 to 200 μm and from 10 to 300 parts by weight of a semiconductive inorganic substance having a specific resistance of from $10^{-2}$ to $10^{8}$ ohm-cm and a particle diameter of not more than 300 μm.

2. The polymer composition of claim 1, wherein the semiconductive inorganic substance is silicon carbide, boron carbide or a mixture thereof.

3. A polymer composition having positive temperature coefficient characteristics, comprising 100 parts by weight of a mixture consisting of from 40 to 90% by weight of a crystalline polymer and from 60 to 10% by weight of an electrically conductive powder having a particle diameter of from 10 to 200 μm and from 10 to 300 parts by weight of a semiconductive inorganic substance having a specific resistance of from $10^{-2}$ to $10^{8}$ ohm-cm and a particle diameter of not more than 300 μm;

said crystalline polymer being high density polyethylene, low density polyethylene, polypropylene, ethylene-propylene copolymer, ethylene-vinylacetate copolymer, polyamide, polyester or fluorine containing ethylene-based polymers, or a combination thereof;

said electrically conductive powder being carbon black, graphite, metal powders, powdered carbon fibers or a mixture thereof; and said semiconductive inorganic substance being silicon carbide, boron carbide or titanium black or a mixture thereof.

4. The polymer composition of claim 3 wherein the semiconductive inorganic substance is either in the form of a powder with an average particle diameter of 30 microns or a fiber with a diameter of 0.1 to 100 microns and a length of from 1 to 5000 microns.

5. The polymer composition of claim 3 wherein there is 15 to 200 parts by weight of said semiconductive inorganic substance.

6. The polymer composition of claim 3 wherein said electrically conductive powder is carbon black and said semiconductive inorganic substance is silicon carbide or boron carbide or a mixture thereof.

7. The polymer of claim 3 wherein said crystalline polymer is high or low density polyethylene, or polypropylene.

8. The polymer of claim 3 wherein said crystalline polymer is ethylene-propylene copolymer or ethylene-vinyacetate copolymer.

9. The polymer of claim 3 wherein said crystalline polymer is polyamide.

10. The polymer of claim 3 wherein said crystalline polymer is polyester.

11. The polymer of claim 3 wherein said crystalline polymer is a fluorine-containing ethylene-based polymer.

12. The polymer of claim 1 wherein said crystalline polymer is high density polyethylene, said electrically conductive powder is carbon black and said semiconductive inorganic substance is silicon carbide or boron carbide.

13. The polymer of claim 1 wherein said crystalline polymer is ethylene-vinyl acetate copolymer, said electrically conductive powder is carbon black and said semi-conductive inorganic substance is silicon carbide.

* * * * *

UNITED STATES PATENT AND TRADEMARK OFFICE

CERTIFICATE OF CORRECTION

PATENT NO. : 4,732,701

DATED : March 22, 1988

INVENTOR(S) : NISHII et al

It is certified that error appears in the above-identified patent and that said Letters Patent is hereby corrected as shown below:

Column 2, line 9, change:

"excess of 200 μm" to --excess of 200 mμ--.

Signed and Sealed this

Fourth Day of August, 1992

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,732,701

DATED : March 22, 1988

INVENTOR(S) : NISHII et al

It is certified that error appears in the above-identified patent and that said Letters Patent is hereby corrected as shown below:

Column 8, line 12 (Claim 1) -

Replace "10 to 200 μm" with --10 to 200 mμ--.

Column 8, line 25 (Claim 3) -

Replace "10 to 200 μm" with --10 to 200 mμ--.

Signed and Sealed this

Twenty-fourth Day of August, 1993

*Attest:*

*Attesting Officer*

BRUCE LEHMAN

*Commissioner of Patents and Trademarks*